US008354367B2

(12) United States Patent
Guyot et al.

(10) Patent No.: US 8,354,367 B2
(45) **Date of Patent: *Jan. 15, 2013**

(54) FABRIC SOFTENING LAUNDRY DETERGENTS WITH GOOD STABILITY

(75) Inventors: Raphael Emmanuel Guyot, Kobe (JP); Marko Tapio Tossavainen, Hoeilaart (BE); Marc Jennewein, Humbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 641 days.

This patent is subject to a terminal disclaimer.

(21) Appl. No.: 12/473,475

(22) Filed: May 28, 2009

(65) Prior Publication Data

US 2009/0293206 A1 Dec. 3, 2009

Related U.S. Application Data

(60) Provisional application No. 61/056,588, filed on May 28, 2008.

(51) Int. Cl.
*C11D 17/00* (2006.01)

(52) U.S. Cl. ..... 510/475; 510/336; 510/341; 510/343; 510/356; 510/426; 510/504

(58) Field of Classification Search ..... None
See application file for complete search history.

(56) References Cited

U.S. PATENT DOCUMENTS

| | | | | |
|---|---|---|---|---|
| 2004/0092425 | A1 | 5/2004 | Boutique et al. | |
| 2006/0276370 | A1 | 12/2006 | Zhang et al. | |
| 2008/0234165 | A1 * | 9/2008 | Panandiker et al. | 510/299 |

FOREIGN PATENT DOCUMENTS

| | | | |
|---|---|---|---|
| WO | WO 03/033636 | A | 4/2003 |
| WO | WO 2007/120547 | A | 10/2007 |
| WO | WO 2008/114171 | A | 9/2008 |

OTHER PUBLICATIONS

U.S. Appl. No. 12/473,483, filed May 28, 2008, Guyot et al.
International Search Report, mailed Sep. 25, 2009, 5 pages.

* cited by examiner

*Primary Examiner* — Necholus Ogden, Jr.
(74) *Attorney, Agent, or Firm* — Melissa G. Krasovec; Steven W. Miller

(57) ABSTRACT

Aqueous laundry detergent compositions useful for providing fabric cleaning and softness, in the form of a liquid or gel, having a pH of from about 6 to about 11 in a 1% solution, containing a non-soap anionic surfactant; optional soap; nonionic surfactant; optional hydrotrope; fabric softening cationic cosurfactant having a molecular weight of less than about 1000; fabric softening quaternized polymer having a molecular weight of at least 200,000; a perfume deposition polyamine wherein the perfume deposition polyamine has a molecular weight of from about 5,000 to about 50,000; a non-quaternized, non polyamine thickener; and perfume. Methods of using such compositions and use of such compositions.

27 Claims, No Drawings

FABRIC SOFTENING LAUNDRY DETERGENTS WITH GOOD STABILITY

CROSS REFERENCE TO RELATED APPLICATION

This Application claims priority to U.S. Provisional Application Ser. No. 61/056,588, filed May 28, 2008.

FIELD OF THE INVENTION

The present invention relates to the field of liquid laundry detergent compositions that provide fabric softening benefits when utilized in a standard consumer laundry washing machine.

BACKGROUND OF THE INVENTION

Numerous aqueous liquid laundry detergent products are commercially available for the laundering of textiles (e.g. bedding, linens, and/or clothing). These products have traditionally focused on stain-removal and cleaning benefits and could be used in laundry washing machines and/or hand-washing applications. Aqueous laundry detergent compositions are therefore well known in the art and often contain surfactants such as anionic and nonionic surfactants.

More recently, such laundry detergent compositions have been formulated with the inclusion of softness technology, such as cationic hydroxyethylcelluloses, to provide consumers with both cleaning and softness benefits through the wash. Importantly, these formulations allow consumers to avoid utilizing a separate rinse-cycle only fabric enhancer product. Such formulations have become more desirable to consumers.

Perfume and freshness technologies have also been developed for use in aqueous liquid laundry detergents to provide consumers with long-lasting scent on their laundered fabrics. Perfume deposition technologies such as the commercially available LUPASOL may be used with specific perfume raw materials such as delta-damascone to drive perfume deposition to the fabrics and deliver a holistic freshness experience to the consumer.

However, It has now surprisingly been discovered that when certain types of cationic fabric softening materials (such as cationic hydroxyethylcellulose) are combined with certain types of perfume deposition promoting polymers (such as Lupasol HF or WF) in an anionic/nonionic surfactant matrix, that upon storage, undesirable precipitates form, and separate out from the detergent. Such undesirable properties include, for example, precipitates sticking onto the walls of a container as unsightly specks or lumps. The problem of precipitation of cationic hydroxyethylcellulose combined with Lupasol type materials, thereby forming unsightly residues in the product was not previously known and was unexpected since both technologies have the same overall charge (cationic).

It is therefore desirable to offer consumers an even better in-use experience, and desirable to provide good cleaning, softness, and holistic freshness in a single, stable, aqueous laundry detergent composition.

SUMMARY OF THE INVENTION

The present invention encompasses aqueous laundry detergent compositions in the form of a liquid or gel, having a pH of from about 6 to about 11 in a 1% solution, containing:

a) from about 5% to about 30%, by weight of the composition, of a non-soap anionic surfactant;

b) from about 0% to about 20%, by weight of the composition, of soap;

c) from about 0.5% to about 30%, by weight of the composition, of a nonionic surfactant;

d) from 0% to about 5%, by weight of the composition, of a hydrotrope;

e) from about 0.1% to about 6%, by weight of the composition, of a fabric softening cationic cosurfactant having a molecular weight of less than about 1000;

f) from about 0.05% to about 1%, by weight of the composition, of a fabric softening quaternized polymer wherein the fabric softening quaternized polymer has a molecular weight of at least 200,000;

g) from about 0.01% to about 0.5%, by weight of the composition, of a perfume deposition polyamine wherein the perfume deposition polyamine has a molecular weight of from about 5,000 to about 50,000;

h) from about 0% to about 0.5%, by weight of the composition, of a non-quaternized, non polyamine thickener; and i) from 0.01% to about 0.5%, by weight of the composition, of perfume.

The present invention further encompasses the above compositions wherein the composition has a pH of from about 7.5 to about 9.5.

The present invention further encompasses the above compositions wherein the composition comprises from about 6% to about 10%, by weight of the composition, of the nonsoap anionic surfactant.

The present invention further encompasses the above compositions wherein the nonsoap anionic surfactant is selected from linear alkylbenzenesulfonates, branched alkylbenzenesulfonates, alkylpoly(ethoxylates), alkyl sulfates, methyl ester sulfonates, and mixtures thereof.

The present invention further encompasses the above compositions wherein the composition comprises from about 0.5% to about 20%, by weight of the composition, of the soap.

The present invention further encompasses the above compositions wherein the composition comprises from about 4% to about 10%, by weight of the composition, of the soap and the soap is selected from oleic acid soaps, palmitic acid soaps, palm kernel fatty acid soaps, and mixtures thereof.

The present invention further encompasses the above compositions wherein the ratio of nonionic surfactant to nonsoap anionic surfactant is at least 1:1.

The present invention further encompasses the above compositions wherein the composition comprises from 0.5% to about 5%, by weight of the composition, of the hydrotrope.

The present invention further encompasses the above compositions wherein the hydrotrope is selected from sodium salt, potassium salt, alkanolammonium salt and acid forms of cumene sulfonic acid, toluene sulfonic acid, xylenesulfonic acid and mixtures thereof.

The present invention further encompasses the above compositions wherein the molecular weight of the fabric softening cationic cosurfactant is less than 300.

The present invention further encompasses the above compositions wherein the fabric softening cationic cosurfactant is water-soluble and comprises no more than four quaternized nitrogen atoms.

The present invention further encompasses the above compositions wherein the fabric softening cationic cosurfactant is water-soluble and comprises one quaternized nitrogen atom.

The present invention further encompasses the above compositions wherein the fabric softening cationic cosurfactant further comprises one long-chain hydrocarbyl group.

The present invention further encompasses the above compositions wherein the fabric softening cationic cosurfactant is selected from water-soluble alkyltrimethylammonium salts or their hydroxyalkyl substituted analogs.

The present invention further encompasses the above compositions wherein the fabric softening cationic cosurfactant is selected from compounds having the formula $R_1R_2R_3R_4N^+X^-$ wherein $R_1$ is a $C_8$-$C_{16}$ alkyl, each of $R_2$, $R_3$ and $R_4$ is independently selected from $C_1$-$C_4$ alkyl, $C_1$-$C_4$ hydroxy alkyl, benzyl, and —$(C_2H_4O)_xH$ where x has a value from 2 to 5, and X is an anion; and wherein not more than one of $R_2$, $R_3$ or $R_4$ is benzyl.

The present invention further encompasses the above compositions wherein the fabric softening cationic cosurfactant is dodecyltrimethylammonium chloride.

The present invention further encompasses the above compositions wherein the fabric softening quaternized polymer is a naturally derived hydroxyl-substituted derivative.

The present invention further encompasses the above compositions wherein the fabric softening quaternized polymer is cationic hydroxyethylcellulose.

The present invention further encompasses the above compositions wherein the perfume deposition polyamine has a molecular weight of from about 10,000 to about 30,000 and the polyamine comprises at least some primary amine moieties.

The present invention further encompasses the above compositions wherein the perfume deposition polyamine is selected from polyethyleneimines.

The present invention further encompasses the above compositions wherein the perfume deposition polyamine is selected from polyethyleneimine polymers; poly[oxy(methyl-1,2-ethanediyl)]-(2-aminomethylethyl)-(2-aminomethyl-ethoxy); poly[oxy(methyl-1,2-ethanediyl)]-hydro-)-(2-aminomethylethoxy)-ether with 2-ethyl-2-(hydroxymethyl)-1,3-propanediol; 2,2',2"-triaminotriethylamine; 2,2'-diamino-diethylamine-I 3,3'-diamino-dipropylamine, 1,3 bis aminoethyl-cyclohexane; C12 Sternamines; and mixtures thereof.

The present invention further encompasses the above compositions wherein the perfume comprises delta-damascone.

The present invention further encompasses the above compositions wherein the non-quaternized, non polyamine thickener is selected from methylcellulose, hydroxypropylmethylcellulose, xantham gum, gellan gum, guar gum, hydroxypropyl guar gum, succinoglycan, trihydroxystearin, castor oil, hydrogenated castor oil, hydrogenated castor wax, and mixtures thereof.

The present invention further encompasses the above compositions wherein the composition further comprises a laundry adjunct selected from enzyme stabilizers, dyes, brighteners, opacifiers, pearlescent agents, perfume microcapsules, and mixtures thereof.

The present invention further encompasses aqueous laundry detergent composition in the form of a liquid or gel, having a pH of from about 6 to about 11 in a 1% solution, containing a) from about 5% to about 30%, by weight of the composition, of a non-soap anionic surfactant;

b) from about 1% to about 15%, by weight of the composition, of soap;

c) from about 0.5% to about 30%, by weight of the composition, of a nonionic surfactant;

d) from 0.5% to about 5%, by weight of the composition, of a hydrotrope;

e) from about 0.5% to about 5%, by weight of the composition, of a fabric softening cationic cosurfactant selected from dodecyltrimethylammonium chloride;

f) from about 0.05% to about 1%, by weight of the composition, of a fabric softening quaternized polymer wherein the fabric softening quaternized polymer has a molecular weight of at least 400,000;

g) from about 0.01% to about 0.5%, by weight of the composition, of a perfume deposition polyamine selected from polyethyleneimines having a molecular weight of from about 10,000 to about 30,000;

h) from about 0.05% to about 0.5%, by weight of the composition, of a non-quaternized, non polyamine thickener selected from hydroxypropylmethylcellulose, methylcellulose and mixtures thereof; and i) from 0.05% to about 0.5%, by weight of the composition, of perfume.

The present invention further encompasses use of a low molecular weight cationic cosurfactant for stabilizing a liquid or gel laundry detergent composition that is otherwise prone to precipitate solids, wherein the composition contains:

a) a fabric softening hydroxyl-substituted quaternized polymer having a molecular weight of greater than 200,000; and b) a perfume deposition polyamine having a molecular weight of less than 50,000.

The present invention further encompasses a method of cleaning and softening textiles, wherein said method comprises the steps of adding the textiles and a sufficient amount of a laundry composition above to the drum of a standard consumer laundry washing machine and then actuating the washing machine to operate a normal consumer laundry wash cycle.

DETAILED DESCRIPTION OF THE INVENTION

It has now been surprisingly found that by adding a low molecular weight cationic cosurfactant to an anionic and nonionic surfactant-containing detergent composition that also contains a fabric softening quaternized polymer and a perfume deposition polyamine, that product stability can be achieved. Furthermore, stability is achieved while maintaining cleaning and softening properties. Therefore, the detergent compositions provided herein are economical, provide good cleaning, fabric softening and perfume deposition, and are capable of being stored for extended periods of time without unsightly deposits being formed in the bottle. Further, the aqueous laundry detergents of the present invention meet the stringent storage testing conditions (including freeze-thaw testing) required for laundry detergents to be marketable in Japan.

The aqueous laundry detergent compositions herein have a pH of from about 6 to about 11 in a 1% aqueous solution, and contain a fabric softening quaternized polymer, a perfume deposition polyamine, a fabric softening cationic cosurfactant, an anionic surfactant, a nonionic surfactant, and, in an alternate embodiment, a thickener. Each of these components as well as optional ingredients for such compositions and methods of preparing and using such compositions are described in detail as follows.

All measurements referenced herein are at room temperature (about 21.1° C.) and at atmospheric pressure, unless otherwise indicated.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages, parts and ratios are based upon the total weight of the liquid laundry detergent compositions of the present invention, unless otherwise specified. All such weights as they pertain to listed ingredients are based on the active level and, therefore, do not include carriers or by-products that may be included in commercially available materials, unless otherwise specified.

All documents cited are, in relevant part, incorporated herein by reference; the citation of any document is not to be construed as an admission that it is prior art with respect to the present invention.

Aqueous Laundry Detergent Composition

The compositions of the present invention are aqueous, meaning that they contain at least 5% water. Other types of water-miscible liquids, such alkanols, diols, other polyols, ethers, amines, and the like, can be added to liquid detergent compositions as co-solvents or stabilizers. However, these other liquids are often more costly. The aqueous laundry compositions of the present invention may be in the form of a liquid or gel. In one embodiment, the compositions comprise from about 30% to 70%, alternatively 35% to 50%, still alternatively from about 10% to 25%, by weight of the composition, of water.

The laundry detergent compositions herein have a pH of from about 6 to about 11 in a 1% solution in water. Preferably, the pH is from about 7.5 to about 9.

Perfume Deposition Polyamine (LUPASOL)

The aqueous detergent compositions of the present invention contain from about 0.01% to about 0.5%, alternatively from about 0.01% to about 0.4%, by weight of the composition, of a perfume deposition polyamine having a molecular weight of from about 5,000 to about 50,000. In one embodiment, the molecular weigh is from about 10,000 to about 30,000.

In one embodiment, the perfume deposition polyamine contains at least some primary amine moieties. Preferred polyamines contain at least some primary, secondary and tertiary amine moieties. Preferred polyamines include polyethyleneimines.

Polyamines useful herein include polyethyleneimine polymers, poly[oxy(methyl-1,2-ethanediyl)], -(2-aminomethylethyl)-(2-aminomethyl-ethoxy)-(=C.A.S No. 9046-10-0); poly[oxy(methyl-1,2-ethanediyl)], -hydro-)-(2-aminomethylethoxy)-, ether with 2-ethyl-2-(hydroxymethyl)-1,3-propanediol (=C.A.S. No. 39423-51-3); commercially available under the tradename JEFFAMINES T-403, D-230, D-400, D-2000; 2,2',2"-triaminotriethylamine; 2,2'-diamino-diethylamine-I 3,3'-diamino-dipropylamine, 1,3 bis aminoethyl-cyclohexane commercially available from Mitsubushi and the C12 Sternamines commercially available from Clariant like the C12 Sternamin(propylenamine), with n=¾, and mixtures thereof. Preferred polyamines are polyethyleneimines commercially available under the tradename LUPASOL like LUPASOL FG, G20, WFV, PR8515, WF, FC, G20, G35, G100, HF, P, PS, SK, SNA.

Importantly, but without being limited by theory, the effectiveness of the compositions herein is compromised when the polyamine molecular weight is too low. For example although polyamines with molecular weights as low as 800 and 2,000 have good stability (avoid precipitation), at that molecular weight the polyamine no longer works to enhance perfume deposition.

In one embodiment, the perfume deposition polyamine has a molecular weight of from about 10,000 to about 30,000 and the polyamine comprises at least some primary amine moieties.

In another embodiment, the perfume deposition polyamine is selected from polyethyleneimines.

In another embodiment, the perfume deposition polyamine is selected from polyethyleneimine polymers; poly[oxy(methyl-1,2-ethanediyl)]-(2-aminomethylethyl)-(2-aminomethyl-ethoxy); poly[oxy(methyl-1,2-ethanediyl)]-hydro-)-(2-aminomethylethoxy)-ether with 2-ethyl-2-(hydroxymethyl)-1,3-propanediol; 2,2',2"-triaminotriethylamine; 2,2'-diamino-diethylamine-I 3,3'-diamino-dipropylamine, 1,3 bis aminoethyl-cyclohexane; C12 Sternamines; and mixtures thereof.

Fabric Softening Quaternized Polymer (CAT-HEC)

The aqueous detergent compositions of the present invention contain from about 0.05% to about 1%, alternatively from about 0.1% to about 0.3%, by weight of the composition, of a fabric softening quaternized polymer having a molecular weight of at least 200,000. In one embodiment, the fabric softening quaternized polymer has a molecular weight of greater than 400,000.

In one embodiment, the fabric softening quaternized polymer is cationic hydroxyethylcellulose. Without being limited by theory, some consumers, especially Japanese consumers prefer detergent compositions containing naturally derived materials such as cationic hydroxyethylcellulose. However, synthetic materials (such as PAM/MAPTAC) could be used in the alternative, provided they have suitable molecular weight.

Other fabric softening quaternized polymers useful herein include any of the known Polyquaterniums provided that (a) they are selected to respect the molecular weight requirement and (b) that polyethyleneimine having molecular weight of 25,000 or above is excluded as the fabric softening quaternized polymer (it has been discovered that polyethyleneimine in combination with high molecular weight fabric softening quaternized polymers may result in precipitate formation leading to an undesirable formulation).

In one embodiment, the fabric softening quaternized polymer is a naturally derived hydroxyl-substituted derivative such as any cationic polyhydroxy compounds which can be derived from starches or gums.

Fabric Softening Cationic Cosurfactant

The aqueous laundry detergent compositions herein contain from about 0.1% to about 6%, by weight of the composition, of a fabric softening cationic cosurfactant having a molecular weight of less than about 1000. In one embodiment, the fabric softening cationic cosurfactant has a molecular weight of less than about 600, alternatively less than about 300; alternatively still, less than 200.

In one embodiment, the composition contains from about 1% to about 4%, alternatively from about 1% to about 3%, by weight of the composition, of the fabric softening cationic cosurfactant.

In one embodiment, the ratio of anionic surfactant to fabric softening cationic cosurfactant is from about 3:1 to about 20:1.

Although not preferred, it is possible herein to utilize an amine oxide such as dodecyldimethylamine-N-oxide for the fabric softening cationic cosurfactant. This is especially a selection in lower pH detergent embodiments within the range of pH from about 6 to about 8.5. Without being limited by theory, as the pH decreases, increasing proportions of the amine oxide become protonated and the amine oxide behaves as a substitute for the permanently cationic cosurfactant.

In one embodiment, the fabric softening cationic cosurfactant is water-soluble and comprises no more than four quaternized nitrogen atoms.

In one embodiment the fabric softening cationic cosurfactant contains less than 10 ppm of trimethylamine and/or dimethylamine impurities, more preferably less than 2 ppm. Without being limited by theory, compositions containing greater than 10 ppm of trimethylamine and/or dimethylamine will have poor odor quality.

In one embodiment, the fabric softening cationic cosurfactant is water-soluble and comprises one quaternized nitrogen atom, and further contains one long-chain hydrocarbyl group. In another embodiment, the fabric softening cationic cosurfactant is selected from water-soluble alkyltrimethylammonium salts or their hydroxyalkyl substituted analogs.

In one embodiment, the fabric softening cationic cosurfactant is selected from compounds having the formula $R_1R_2R_3R_4N^+X^-$ wherein $R_1$ is a $C_8$-$C_{16}$ alkyl, each of $R_2$, $R_3$ and $R_4$ is independently selected from $C_1$-$C_4$ alkyl, $C_1$-$C_4$ hydroxy alkyl, benzyl, and —$(C_2H_{40})_xH$ where x has a value from 2 to 5, and X is an anion; and wherein not more than one of $R_2$, $R_3$ or $R_4$ is benzyl.

In a preferred embodiment, the fabric softening cationic cosurfactant is dodecyltrimethylammonium chloride although alternately bromide, methosulfate or other water-soluble anions can be used as replacements for chloride.

Thickener (THIXCIN)

The aqueous detergent compositions of the present invention contain from about 0.05% to about 0.5%, by weight of the composition, of a non-quaternized, non polyamine thickener. Thickeners useful herein include rheology modifiers, structurants and combinations thereof.

Structurants useful herein include methylcellulose, hydroxypropylmethylcellulose such as METHOCEL® trade name from Dow Chemical, xanthan gum, gellan gum, guar gum, hydroxypropyl guar gum, succinoglycan and trihydroxystearin. Other illustrative examples of structurants includes the nonpolymeric hydroxyfunctional structurants. Without being limited by theory, a structurant is incorporated into a detergent composition to establish desired rheological characteristics in a liquid product.

Other structurants useful herein include non-polymeric, crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Examples of hydroxyl-containing structurants include castor oil and its derivatives. More specifically, useful herein are hydrogenated castor oil derivatives such as hydrogenated castor oil and hydrogenated castor wax. Commercially available, castor oil-based, crystalline, hydroxyl-containing structurants include THIXCIN® from Rheox, Inc. See also U.S. Pat. No. 6,080,708 and PCT Publication No. WO 02/40627. Another commercially available structurant is 1,4-di-O-benzyl-D-Threitol in the R,R, and S,S forms and any mixtures, optically active or not.

The structurant or thickener herein is preferably not hydrolysed, however for avoidance of doubt, the detergent compositions herein may contain fatty acids or fatty soaps derived from hydrolysis of the thickener, such as various hydroxystearic acids or their salts.

In one embodiment, the non-quaternized, non polyamine thickener is selected from methylcellulose, hydroxypropylmethylcellulose, xantham gum, gellan gum, guar gum, hydroxypropyl guar gum, succinoglycan, trihydroxystearin, castor oil, hydrogenated castor oil, hydrogenated castor wax, and mixtures thereof.

Anionic Surfactant

The aqueous laundry detergent compositions herein contain an anionic surfactant. Any non-soap anionic surfactant known in the art for use in laundry detergents may be utilized. The compositions contain from about 5% to about 30%, by weight of the composition, of the non-soap anionic surfactant. In one embodiment, the composition contains from about 6% to about 15%, alternatively from about 6% to about 8%, by weight of the composition, of the non-soap anionic surfactant.

In one embodiment, the anionic surfactant is selected from linear alkylbenzenesulfonates, branched alkylbenzenesulfonates, alkylpoly(ethoxylates), alkyl sulfates, methyl ester sulfonates, and mixtures thereof. The Hydrophilicity Index of the anionic surfactant may vary widely.

Examples of anionic surfactants useful herein include any of the common anionic surfactants such as linear or modified, e.g., branched, alkylbenzenesulfonate surfactants, alkylpoly (ethoxylate) surfactants, alkyl sulfates, methyl ester sulfonates, or mixtures thereof. Generally speaking, anionic surfactants useful herein are disclosed in U.S. Pat. No. 4,285,841, Barrat et al., issued Aug. 25, 1981, and in U.S. Pat. No. 3,919,678, Laughlin, et al., issued Dec. 30, 1975.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_{8-18}$ carbon atoms) such as those produced by reducing the glycerides of tallow or coconut oil.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly preferred anionic surfactants herein are the alkyl polyethoxylate sulfates of the formula:

$$RO(C_2H_4O)_xSO_3^-M^+$$

wherein R is an alkyl chain having from about 10 to about 22 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 1 to about 15.

Other preferred anionic surfactants are the non-ethoxylated $C_{12-15}$ primary and secondary alkyl sulfates. Under cold water washing conditions, i.e., less than about 65° F. (18.3° C.), it is preferred that there be a mixture of such ethoxylated and non-ethoxylated alkyl sulfates.

Mixtures of the alkyl sulfates with the above-described paraffin sulfonates, alkyl glyceryl ether sulfonates and esters of $\alpha$-sulfonated fatty acids, are also preferred.

The anionic surfactant may also be selected from alkyl benzene sulfonates. In one embodiment, the composition comprises less than 6%, by weight of the composition, of alkyl benzene sulfonates. These include alkylbenzene sulfonates in which the alkyl group contains from about 9 to about 15 carbon atoms, in straight chain or branched chain configuration, e.g., those of the type described in U.S. Pat. No. 2,220,099 and No. 2,477,383.

Soap

The aqueous laundry detergent compositions herein may contain soap. While the invention includes embodiments having no soap, preferred embodiments include soap. Without being limited by theory, it may be desirable to include soap as it acts in part as a surfactant and in part as a builder and may also be useful for suppression of foam. Moreover, without being limited by theory, the soap may interact favorably with the various cationic compounds of the composition to enhance softness on textile fabrics treaded with the inventive compositions. Any soap known in the art for use in laundry detergents may be utilized. In one embodiment, the compositions contain from 0% to about 20%, alternatively from about 0.5% to about 20%, alternatively from about 4% to about 10%, alternatively from about 4% to about 7%, by weight of the composition, of soap.

Examples of soap useful herein include oleic acid soaps, palmitic acid soaps, palm kernel fatty acid soaps, and mixtures thereof. Typical soaps are in the form of mixtures of fatty acid soaps having different chainlengths and degrees of substitution. One such mixture is topped palm kernel fatty acid.

In one embodiment, the soap is selected from free fatty acid. Suitable fatty acids are saturated and/or unsaturated and can be obtained from natural sources such a plant or animal esters (e.g., palm kernel oil, palm oil, coconut oil, babassu oil, safflower oil, tall oil, castor oil, tallow and fish oils, grease, and mixtures thereof), or synthetically prepared (e.g., via the oxidation of petroleum or by hydrogenation of carbon monoxide via the Fisher Tropsch process). Examples of suitable saturated fatty acids for use in the compositions of this invention include captic, lauric, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{12}$ fatty acid, saturated $C_{12}$-$C_{14}$ fatty acids, and saturated or unsaturated $C_{12}$ to $C_{18}$ fatty acids, and mixtures thereof.

When present, the weight ratio of fabric softening cationic cosurfactant to fatty acid is preferably from about 1:3 to about 3:1, more preferably from about 1:1.5 to about 1.5:1, most preferably about 1:1.

Levels of soap and of nonsoap anionic surfactants herein are percentages by weight of the detergent composition, specified on an acid form basis. However, as is commonly understood in the art, anionic surfactants and soaps are in practice neutralized using sodium, potassium or alkanolammonium bases, such as sodium hydroxide or monoethanolamine.

Nonionic Surfactant

The aqueous laundry detergent compositions herein contain a nonionic surfactant. Any nonionic surfactant known in the art for use in laundry detergents may be utilized. The compositions contain from about 0.5% to about 30%, by weight of the composition, of the nonionic surfactant. In one embodiment, the composition contains from about 5% to about 15%, alternatively from about 8% to about 12%, by weight of the composition, of the nonionic surfactant.

In one embodiment, the ratio of anionic surfactant to nonionic surfactant is equal to or greater than 1.

Examples of nonionic surfactants useful herein include long-chain alkyl poly(ethoxylates), such as C12-C16(EO)xH where EO represents ethylene oxide and x can range from 1 to 8.

Other examples of nonionic surfactants useful herein include ethoxylated nonionic surfactants. These materials are described in U.S. Pat. No. 4,285,841, Barrat et al, issued Aug. 25, 1981. In one embodiment, the nonionic surfactant is selected from the ethoxylated alcohols and ethoxylated alkyl phenols of the formula $R(OC_2H_4)$, OH, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one embodiment, the nonionic surfactant is selected from ethoxylated alcohols having an average of from about 10 to about 15 carbon atoms in the alcohol and an average degree of ethoxylation of from about 6 to about 12 moles of ethylene oxide per mole of alcohol.

Hydrotrope

The aqueous laundry detergent compositions herein may contain a hydrotrope. In one embodiment, the composition contains from 0% to about 5%, by weight of the composition, of a hydrotrope, alternatively from about 0.5% to about 5%, alternatively from about 3% to about 5%, of a hydrotrope. Any hydrotrope known in the art for use in laundry detergents may be utilized.

Examples of hydrotropes useful herein include sodium salt, potassium salt, alkanolammonium salt and acid forms of cumene sulfonic acid, toluene sulfonic acid, xylenesulfonic acid and mixtures thereof.

Without being limited by theory, it is desirable to utilize a hydrotrope since it avoids over-thickening of the formulation. In one embodiment, the viscosity of the aqueous laundry detergent is independently controlled by utilization of a hydrotrope and a non-cationic thickener.

Perfume

The aqueous laundry detergent compositions herein contain from about 0.05% to about 0.5%, alternatively from about 0.01% to about 0.5%, by weight of the composition, of a perfume capable of having its deposition enhanced by perfume deposition polyamine (such as LUPASOL™).

In one embodiment, perfumes useful herein interact specifically with intermediate molecular weight water dispersible or soluble polymers comprising at least some primary amine moieties such as the intermediate molecular weight polymers described above.

Perfumes useful herein include delta-damascone, 4-methoxybenzaldehyde; 4-phenylbutan-2-one; 3,7-dimethyl-2-methylene-6-octenal; 4-(2,6,6-trimethyl cyclohex-1-ene-1-yl) but-3-ene-2-one; 2,4-dimethylcyclohex-3-ene-1-carbaldehyde; 2-methyl-3-(para iso propylphenyl) propionaldehyde; 2-Buten-1-one, 1-(2,6,6-trimethyl-1,3-cyclohexadien-1-yl)-; 1-cyclohexyl-ethylene-crotonate;

1-(2,6,6-trimethyl-3-cyclohexen-1-yl)-2-buten-1-one; 3-methyl cyclopentadecenone; 4-(2,6,6-trimethyl-1-cyclohexenyl)butan-2-one; 2,5-Dimethyl-2-octen-6-one; dihydronor-cyclopentadienyl acetate; 3-(o-(and p-)ethylphenyl)-2,2-dimethylpropionaldehyde; 3-(3-isopropylphenyl) butanal; 3-Buten-2-one, 3-methyl-4-(2,6,6-trimethyl-2-cyclohexen-1-yl)-; alpha-methyl-3,4(methylenedioxy)hydrocinnamaldehyde; n-hexyl ortho hydroxy benzoate; 7-acetyl-1,2,3,4,5,6,7,8-octahydro-1,1,6,7,tetramethyl naphthalene; 4-(1-Ethoxyvinyl)-3,3,5,5-tetramethyl-cyclohexan-1-one; 2-cyclohexen-1-one, 2-methyl-5-(1-methylethenyl)-, (R)—; 2,4-Dimethyl-3-cyclohexene-1-carboxaldehyde; 3,7-dimethyl-1,6-octadien-3-ol; 2,6-Dimethyl-5-Heptenal; Methyl Dihydro Jasmonate; Methyl Nonyl Acetaldehyde; 6,6-dimethoxy-2,5,5-trimethylhex-2-ene; 2-Cyclohexen-1-one, 2-methyl-5-(1-methylethenyl)-, (R)—; Octaldehyde; 2-Cyclohexyl-1,6-heptadien-3-one and mixtures thereof.

In one embodiment, the perfume is delta-damascone.

pH Adjustment

Neutralizers and buffers may be used to reach the targeted composition pH. Sodium, potassium and alkanolamines may utilized as neutralizers. Borate or other buffers, or borate-polyol pH jump systems can likewise be utilized herein.

Optional Components

The detergent compositions of the present invention can also include any number of additional optional ingredients. These include conventional laundry detergent composition components such as pearlescent agents, detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, phase stabilizers, structuring agents, dye transfer inhibiting agents, optical brighteners, perfumes, perfume microcapsules, dyes, and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 10% to about 50%, more preferably from about 30% to about 40%, by weight of the composition.

Product Form

The aqueous laundry detergent compositions herein can be clear or hazy, they do not need to be optically isotropic. For avoidance of confusion, haze or opacity does not constitute instability in the product provided that no solids deposit on storage (including freeze-thaw testing).

Stability

Without being limited by theory, it is believed that the liquid detergent compositions of the invention are remarkably stable, even under freeze-thaw testing conditions.

Use of the Composition in Domestic Laundry Washing Machines

The present compositions can be used in domestic laundry washing machines, at typical dosages of from about 20 millilitres to about 130 millilitres, depending on the size of the washing machine, the level of soiling, and the geography of use, since washing machines are adapted for different countries. For use in Japanese washing machines, a typical dose is from about 20 millilitres to about 40 millilitres. The compositions can be used in top-loading or in horizontal or inclined axis washers.

EXAMPLES

The following examples illustrate the compositions of the present invention but are not necessarily meant to limit or otherwise define the scope of the invention herein.

Examples 1A and 1B

Two compositions according to the present invention are prepared by conventional means of combining the ingredients listed in Table I in the proportions shown.

TABLE 1

| Ingredient Name | 1A WT % | 1B WT % |
|---|---|---|
| HLAS | 6.0 | 6.5 |
| NI 24-7 | 9.0 | 8.5 |
| Citric Acid | 1.50 | 1.30 |
| C1218 TPK FA | 5 | 5.5 |
| Enzymes | 0.3 | 0.2 |
| Boric acid (MEA Borate) | 1.0 | 8.5 |
| CaCl2 | 0.020 | 0.020 |
| HEDP | 0.10 | 0.10 |
| Lupasol HF | 0.04 | 0.03 |
| dodecyltrimethylammonium chloride | 0.5 | 1.5 |
| cationic hydroxyethylcellulose | 0.2 | 0.20 |
| Hydrogenated Castor Oil | 0 | 0.10 |
| Ethanol | 3.0 | 3.0 |
| 1,2 propanediol | 5.5 | 6.0 |
| MEA | 3.0 | 0.30 |
| NaOH | 0.5 | 2.8 |
| NaCS | 0 | 4.5 |
| Perfumes and Dyes | 0.4 | 0.3 |
| Water | to 100% | To 100% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to include also "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous laundry detergent composition in the form of a liquid or gel, having a pH of from about 6 to about 11 in a 1% solution, said composition comprising a cationic fabric softening agent and a perfume deposition polymer, characterized in that the composition comprises:

a) from about 5% to about 30%, by weight of the composition, of a non-soap anionic surfactant;

b) from about 0% to about 20%, by weight of the composition, of soap;

c) from about 0.5% to about 30%, by weight of the composition, of a nonionic surfactant;

d) from 0% to about 5%, by weight of the composition, of a hydrotrope;

e) from about 0.1% to about 6%, by weight of the composition, of a fabric softening cationic cosurfactant having a molecular weight of less than about 1000;

f) from about 0.05% to about 1%, by weight of the composition, of a fabric softening quaternized polymer wherein the fabric softening quaternized polymer has a molecular weight of at least 200,000;

g) from about 0.01% to about 0.5%, by weight of the composition, of a perfume deposition polyamine wherein the perfume deposition polyamine has a molecular weight of from about 5,000 to about 50,000;

h) from about 0% to about 0.5%, by weight of the composition, of a non-quaternized, non polyamine thickener; and i) from 0.01% to about 0.5%, by weight of the composition, of perfume microcapsules.

2. A laundry detergent composition according to claim 1 wherein the composition has a pH of from about 7.5 to about 9.5.

3. A laundry detergent composition according to claim 1 wherein the composition comprises from about 6% to about 10%, by weight of the composition, of the nonsoap anionic surfactant.

4. A laundry composition according to claim 1 wherein the nonsoap anionic surfactant is selected from linear alkylbenzenesulfonates, branched alkylbenzenesulfonates, alkylpoly (ethoxylates), alkyl sulfates, methyl ester sulfonates, and mixtures thereof.

5. A laundry detergent composition according to claim 1 wherein the composition comprises from about 0.5% to about 20%, by weight of the composition, of the soap.

6. A laundry detergent composition according to claim 5 wherein the composition comprises from about 4% to about 10%, by weight of the composition, of the soap and the soap is selected from oleic acid soaps, palmitic acid soaps, palm kernel fatty acid soaps, and mixtures thereof.

7. A laundry detergent composition according to claim 1 wherein the ratio of nonionic surfactant to nonsoap anionic surfactant is at least 1:1.

8. A laundry detergent composition according to claim 1 wherein the composition comprises from 0.5% to about 5%, by weight of the composition, of the hydrotrope.

9. A laundry detergent composition according to claim 8 wherein the hydrotrope is selected from sodium salt, potassium salt, alkanolammonium salt and acid forms of cumene sulfonic acid, toluene sulfonic acid, xylenesulfonic acid and mixtures thereof.

10. A laundry detergent composition according to claim 1 wherein the molecular weight of the fabric softening cationic cosurfactant is less than 300.

11. A laundry detergent composition according to claim 1 wherein the fabric softening cationic cosurfactant is water-soluble and comprises no more than four quaternized nitrogen atoms.

12. A laundry detergent composition according to claim 11 wherein the fabric softening cationic cosurfactant is water-soluble and comprises one quaternized nitrogen atom.

13. A laundry detergent composition according to claim 11 wherein the fabric softening cationic cosurfactant further comprises one long-chain hydrocarbyl group.

14. A laundry detergent composition according to claim 1 wherein the fabric softening cationic cosurfactant is selected from water-soluble alkyltrimethylammonium salts or their hydroxyalkyl substituted analogs.

15. A laundry detergent composition according to claim 1 wherein the fabric softening cationic cosurfactant is selected from compounds having the formula $R_1R_2R_3R_4N^+X^-$ wherein $R_1$ is a $C_8$-$C_{16}$ alkyl, each of $R_2$, $R_3$ and $R_4$ is independently selected from $C_1$-$C_4$ alkyl, $C_1$-$C_4$ hydroxy alkyl, benzyl, and —$(C_2H_4O)_xH$ where x has a value from 2 to 5, and X is an anion;

and wherein not more than one of $R_2$, $R_3$ or $R_4$ is benzyl.

16. A laundry detergent composition according to claim 1 wherein the fabric softening cationic cosurfactant is dodecyltrimethylammonium chloride.

17. A laundry detergent composition according to claim 1 wherein the fabric softening quaternized polymer is a naturally derived hydroxyl-substituted derivative.

18. A laundry detergent composition according to claim 8 wherein the fabric softening quaternized polymer is cationic hydroxyethylcellulose.

19. A laundry detergent composition according to claim 1 wherein the perfume deposition polyamine has a molecular weight of from about 10,000 to about 30,000 and the polyamine comprises at least some primary amine moieties.

20. A laundry detergent composition according to claim 1 wherein the perfume deposition polyamine is selected from polyethyleneimines.

21. A laundry detergent composition according to claim 1 wherein the perfume deposition polyamine is selected from polyethyleneimine polymers; poly[oxy(methyl-1,2-ethanediyl)]-(2-aminomethylethyl)-(2-aminomethyl-ethoxy); poly[oxy(methyl-1,2-ethanediyl)]-hydro-)-(2-aminomethylethoxy)-ether with 2-ethyl-2-(hydroxymethyl)-1,3-propanediol; 2,2',2"-triaminotriethylamine; 2,2'-diamino-diethylamine-I 3,3'-diamino-dipropylamine, 1,3 bis aminoethyl-cyclohexane; C12 Sternamines; and mixtures thereof.

22. A laundry detergent composition according to claim 1 wherein the perfume microcapsules comprise delta-damascone.

23. A laundry detergent composition according to claim 1 wherein the non-quaternized, non polyamine thickener is selected from methylcellulose, hydroxypropylmethylcellulose, xantham gum, gellan gum, guar gum, hydroxypropyl guar gum, succinoglycan, trihydroxystearin, castor oil, hydrogenated castor oil, hydrogenated castor wax, and mixtures thereof.

24. A laundry detergent composition according to claim 1 wherein the composition further comprises a laundry adjunct selected from enzyme stabilizers, dyes, brighteners, opacifiers, pearlescent agents, and mixtures thereof.

25. An aqueous laundry detergent composition in the form of a liquid or gel, having a pH of from about 6 to about 11 in a 1% solution, said composition comprising a cationic fabric softening agent and a perfume deposition polyamine, characterized in that the composition comprises:

a) from about 5% to about 30%, by weight of the composition, of a non-soap anionic surfactant;

b) from about 1% to about 15%, by weight of the composition, of soap;

c) from about 0.5% to about 30%, by weight of the composition, of a nonionic surfactant;

d) from 0.5% to about 5%, by weight of the composition, of a hydrotrope;

e) from about 0.5% to about 5%, by weight of the composition, of a fabric softening cationic cosurfactant selected from dodecyltrimethylammonium chloride;

f) from about 0.05% to about 1%, by weight of the composition, of a fabric softening quaternized polymer wherein the fabric softening quaternized polymer has a molecular weight of at least 400,000;

g) from about 0.01% to about 0.5%, by weight of the composition, of a perfume deposition polyamine selected from polyethyleneimines having a molecular weight of from about 10,000 to about 30,000;

h) from about 0.05% to about 0.5%, by weight of the composition, of a non-quaternized, non polyamine thickener selected from hydroxypropylmethylcellulose, methylcellulose and mixtures thereof;

and i) from 0.05% to about 0.5%, by weight of the composition, of perfume microcapsules.

26. Use of a low molecular weight cationic cosurfactant for stabilizing a liquid or gel laundry detergent composition that is otherwise prone to precipitate solids, wherein said composition comprises:

a) a fabric softening hydroxyl-substituted quaternized polymer having a molecular weight of greater than 200,000;

b) a perfume deposition polyamine having a molecular weight of less than 50,000; and c) perfume microcapsules by combining said cationic surfactant with said composition.

27. A method of cleaning and softening textiles, wherein said method comprises the steps of adding the textiles and a sufficient amount of the laundry composition of claim 1 to the drum of a standard consumer laundry washing machine and then actuating the washing machine to operate a normal consumer laundry wash cycle.

* * * * *